US007922164B2

(12) United States Patent
Nakayama

(10) Patent No.: US 7,922,164 B2
(45) Date of Patent: Apr. 12, 2011

(54) SHEET FINISHING DEVICE AND IMAGE FORMING APPARATUS

(75) Inventor: Yoshihiko Nakayama, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 68 days.

(21) Appl. No.: 12/461,138

(22) Filed: Aug. 3, 2009

(65) Prior Publication Data

US 2010/0025910 A1 Feb. 4, 2010

(30) Foreign Application Priority Data

Aug. 4, 2008 (JP) ..... 2008-200853
May 13, 2009 (JP) ..... 2009-116619

(51) Int. Cl.
*B65H 37/04* (2006.01)

(52) U.S. Cl. ..... 270/58.12; 270/58.08; 399/410

(58) Field of Classification Search ..... 270/58.08, 270/58.09, 58.11, 58.12, 58.13, 58.14, 58.16, 270/58.17; 399/410; 271/213, 218
See application file for complete search history.

(56) References Cited

U.S. PATENT DOCUMENTS 5,201,517 A * 4/1993 Stemmle ..... 271/291
5,351,069 A * 9/1994 Koike et al. ..... 347/215
5,497,984 A * 3/1996 Murakami et al. ..... 270/58.02
6,145,825 A 11/2000 Kunihiro et al.
6,283,354 B1 * 9/2001 Hirota et al. ..... 227/39
6,296,247 B1 10/2001 Tamura et al.
6,494,449 B2 12/2002 Tamura et al.
6,685,180 B2 * 2/2004 Saegusa et al. ..... 270/58.08
7,559,547 B2 * 7/2009 Van Dongen et al. ..... 271/148

FOREIGN PATENT DOCUMENTS

JP 10-246998 9/1998
JP 3571986 7/2004
JP 3667211 4/2005
JP 2006-168860 6/2006
JP 2008-007305 1/2008

OTHER PUBLICATIONS

English language abstract of 2001-072311 submitted for equivalent document JP 3,571,986.
English language abstract of 2002-060118submitted for equivalent document JP 3,667,211.

* cited by examiner

*Primary Examiner* — Patrick Mackey
(74) *Attorney, Agent, or Firm* — Harness, Dickey & Pierce, P.L.C.

(57) ABSTRACT

At the time when an aligning unit collects and aligns a recording sheet, the front portion of a movable supporting member of a collecting tray is moved toward the recording sheet to close a space in the collecting tray. Moreover, the front portion of the movable supporting member abuts against the front end of the recording sheet. As a result, the front end of the recording sheet does not hang loose in the space.

18 Claims, 9 Drawing Sheets

SHEET FINISHING DEVICE AND IMAGE FORMING APPARATUS

CROSS-REFERENCE TO RELATED APPLICATIONS

The present application claims priority to and incorporates by reference the entire contents of Japanese Patent Application No. 2008-200853 filed in Japan on Aug. 4, 2008 and Japanese Patent Application No. 2009-116619 filed in Japan on May 13, 2009.

BACKGROUND OF THE INVENTION

1. Field of the Invention

The present invention generally relates to a sheet finishing device and an image forming apparatus and particularly relates to a compact sheet finishing device that can be installed inside an image forming apparatus.

2. Description of the Related Art

Japanese Patent Application Laid-open No. 2006-168860 discloses a combination of an image forming apparatus and a sheet finishing device that performs finishing processing such as sheet sorting or stapling on sheets output from the image forming apparatus. The sheet finishing device can be detachably attached to the image forming apparatus that can be a copying apparatus, a facsimile apparatus, or a multifunction product (MFP) having copying and facsimileing functions.

More particularly, the sheet finishing device is attached to an outer side surface of the image forming apparatus. Moreover, a collecting tray is provided on an outer side surface of the sheet finishing device. However, this arrangement increases the combined installation area of the image forming apparatus.

Japanese Patent No. 3571986 and Japanese Patent No. 3667211 each discloses an image forming apparatus in which a sheet finishing device is installed inside the main body of the image forming apparatus. This arrangement enables reduction in the installation area of the image forming apparatus.

In the configuration disclosed in Japanese Patent No. 3571986, the sheet finishing device is installed in a space between an image forming unit and an image reading unit of the image forming apparatus. This arrangement enables suppressing increase of the height the image forming apparatus. To enable proper installation of the sheet finishing device in that particular space, the sheet finishing device is provided with following units. That is, the sheet finishing device is provided with an aligning unit that collects recording sheets one by one from the image forming unit in the direction parallel to a conveying direction of the recording sheets and aligns the rear ends of the recording sheets, a stapling unit that staples the recording sheets aligned by the aligned unit to obtain a sheet stack, and a collecting tray for stacking the sheet stack stapled by the stapling unit or the recording sheets conveyed from the aligning unit.

The collecting tray is rotatably attached by a base member at the downstream side of a conveying direction of the sheet stack. A front portion of the collecting tray situated at the upstream side of the conveying direction is biased with a spring such that the front portion moves according to the number of recording sheets in the sheet stack.

In the configuration disclosed in Japanese Patent No. 3667211 the sheet finishing device is installed in a space between an image forming unit and an image reading unit of the image forming apparatus. This arrangement enables suppressing increase of the height the image forming apparatus. The sheet finishing device also includes an aligning unit that collects recording sheets conveyed one by one from the image forming unit in the direction parallel to a conveying direction of the recording sheets and aligns the rear ends of the recording sheets, a stapling unit that staples the recording sheets aligned by the aligned unit to obtain a sheet stack, and a collecting tray for stacking the sheet stack stapled by the stapling unit or the recording sheets conveyed from the aligning unit.

In the sheet finishing device disclosed in Japanese Patent No. 3571986, the aligning unit has a sheet supporting surface that is inclined with respect to the conveying direction. The recording sheets conveyed to the aligning unit are collected on the sheet supporting surface and the weight of the collected recording sheets pushes the rear ends thereof to abut against rear end referencing members of the aligning unit for alignment and positioning. For such a configuration to work, the sheet supporting surface needs to be inclined by an angle that is large enough to make the recording sheets slide down toward the rear end referencing members. That increases the height of the aligning unit thereby putting limitations on the height reduction of the image forming apparatus.

In the sheet finishing device disclosed in Japanese Patent No. 3667211, a sheet supporting surface of the aligning unit lies substantially parallel to the conveying direction of the recording sheets. On the one hand, that allows reduction in the height of the aligning unit. However, on the other hand, alignment and positioning of the recording sheets at rear end referencing members remains inadequate. This problem is described below with reference to FIG. 12.

FIG. 12 is a schematic diagram for explaining the relation between a collecting tray 3 and rear end referencing members 2*b* of an aligning unit 2 in a sheet finishing device 1 disclosed in Japanese Patent No. 3667211. A conveying roller 4 conveys image-recorded sheets S that are output from an image forming unit (not shown) into the sheet finishing device 1. A reverse conveying member (not shown) reverses the image-recorded sheets S so that rear ends Sb thereof becomes front ends Sa and conveys the reversed image-recorded sheets S to the aligning unit 2. The image-recorded sheets S rest on a supporting surface 3*a* of the collecting tray 3 and a supporting surface 2*a* of the aligning unit 2. A level difference H between the supporting surfaces 3*a* and 2*a* causes the rear ends Sb of the image-recorded sheets S to abut against the rear end referencing members 2*b* of the aligning unit 2 for alignment and positioning.

A stapling unit (not shown) staples the aligned rear ends Sb to form a sheet stack of the image-recorded sheets S. The sheet stack drops along an inclined surface 3*b* and rests at a regulating fence 3*d* that is formed at the end of a bottom portion 3*c* having a level difference A from the supporting surface 2*a* of the aligning unit 2. To enable collection of the sheet stack in the collecting tray 3 in the abovementioned manner, the level difference A is maintained between the bottom portion 3*c* of the collecting tray 3 and the supporting surface 2*a* of the aligning unit 2 and a space D is maintained between the supporting surface 3*a* of the collecting tray and the supporting surface 2*a* of the aligning unit 2.

However, consider a case when the collected image-recorded sheets S that are shorter in length than a length L0 from the rear end referencing members 2*b* to the supporting surface 3*a* in the collecting tray 3 are aligned and positioned at the rear end referencing members 2*b*. Then, as shown in FIG. 12, because a length L1 from the rear end referencing members 2*b* to an end edge 2*a*1 of the supporting surface 2*a* is shorter than the length of the image-recorded sheets S, the front ends Sa of the image-recorded sheets S hang loose in the space D and the image-recorded sheets S move due to the weight of the hanging front ends Sa. That causes a misalignment Z in the rear ends Sb of the image-recorded sheets S having been aligned at the rear end referencing members 2*b*. As a result, it becomes likely that stapling is performed with the rear ends Sb out of alignment.

SUMMARY OF THE INVENTION

It is an object of the present invention to at least partially solve the problems in the conventional technology.

According to an aspect of the present invention, there is provided a sheet finishing device that includes an aligning unit that collects a recording sheet on which an image forming unit has formed an image and aligns rear end of the recording sheet, the aligning unit having a sheet supporting surface that is shorter in length than a length of the recording sheet in a conveying direction; and a collecting tray in which the recording sheet aligned by the aligning unit is collected. The collecting tray includes a fixed collecting member that collects and houses the recording sheet in a bottom portion thereof having a level difference in the conveying direction with respect to the sheet supporting surface of the aligning unit; and a movable supporting member that is rotatably attached to an intermediate portion of the fixed collecting member along the conveying direction by a base member such that a front portion of the movable supporting member is able to move closer to or far from the recording sheet. When the aligning unit collects the recording sheet, the front portion of the movable supporting member rotates toward the recording sheet and abuts against a front portion of the recording sheet to control position of the rear end of the recording sheet in the aligning unit.

According to another aspect of the present invention, there is provided an image forming apparatus that includes an image forming unit that forms an image on a recording sheet; and the above sheet finishing device that performs finishing processing on the recording sheet.

According to still another aspect of the present invention, there is provided a sheet finishing device that includes an aligning unit configured to receive a recording sheet one by one from an image forming unit and to align rear ends of the recording sheets to make a sheet stack, the aligning unit having a sheet supporting surface that is shorter in length than a shortest length of a smallest handelable paper of the recording sheet in a conveying direction of the recording sheets; and a collecting unit configured to receive the sheet stack from the aligning unit. The collecting unit includes a fixed member arranged in a fixed manner relative to the sheet supporting surface of the aligning unit, the fixed member having a first portion located toward the aligning unit and a second portion located away from the aligning unit, the fixed member configured to collect the sheet stack in the first portion, an end of the first portion located toward the aligning unit being situated at a lower level with respect to the sheet supporting surface in the conveying direction; a rotational member having a rotatably-fixed end and a free end, the rotatably-fixed end being rotatably attached to the fixed member at a junction of the first portion and the second portion with a rotational axis perpendicular to the conveying direction so that the free end rotates freely in the conveying direction; and a rotation control unit that controls rotation of rotational member, wherein, when a sheet stack is present on the sheet supporting surface of the aligning unit, the rotation control unit causes the rotational member to rotate so that the free end lifts up a hanging end of the sheet stack.

According to still another aspect of the present invention, there is provided an image forming apparatus that includes an outer body; an image forming unit arranged inside the outer body and configured to form an image on a recording sheet; and the above sheet finishing device arranged inside the outer body and configured to perform certain processing on the recording sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to these embodiments.

Figure 1:
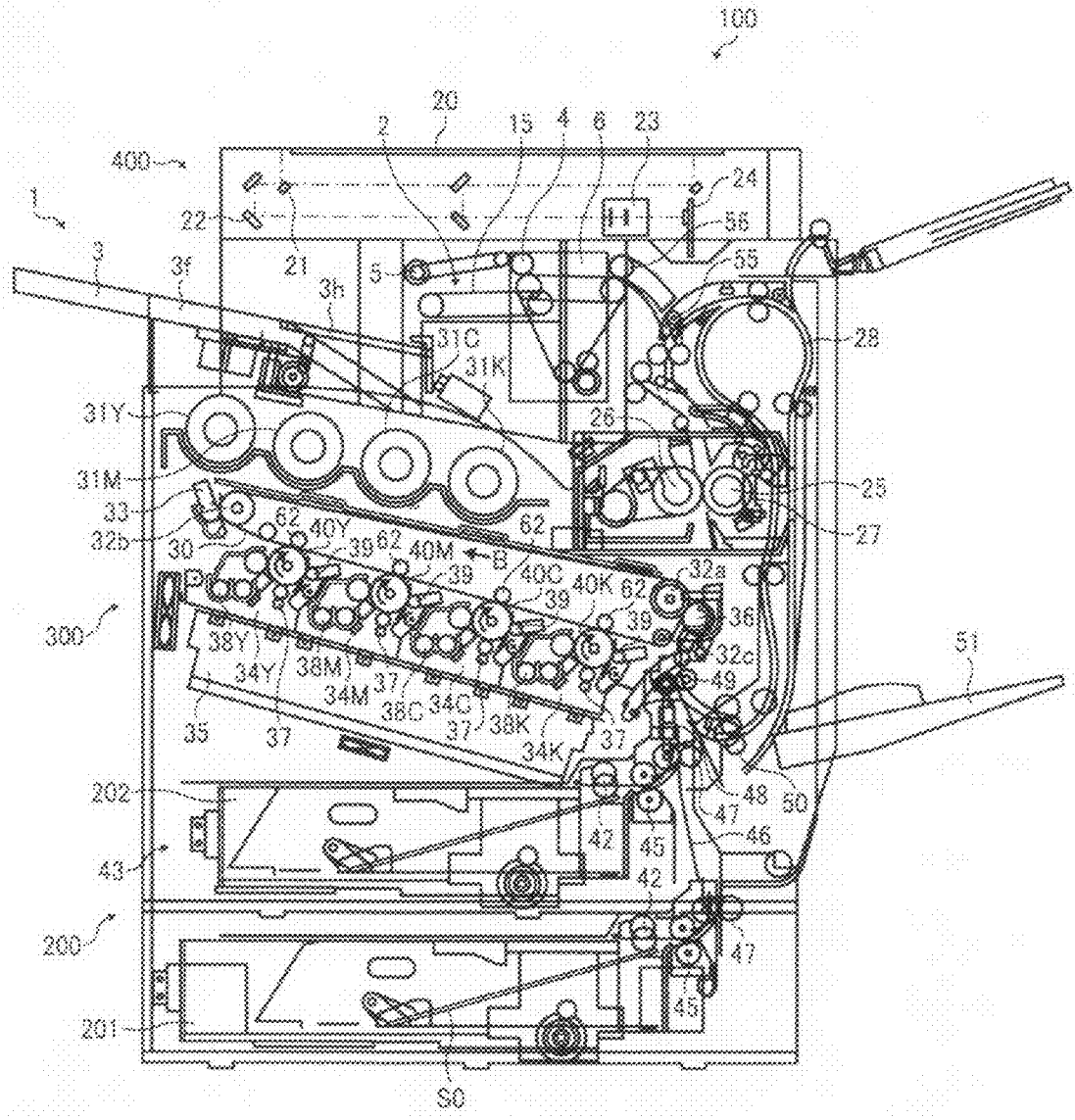
FIG. 1 is a schematic diagram of an exemplary configuration of an image forming apparatus according to a first embodiment of the present invention.

FIG. 1 is a schematic diagram of an exemplary configuration of an image forming apparatus 100 according to a first embodiment of the present invention. The image forming apparatus 100 includes a sheet storing unit 200 that is used to store recording sheets S0 (e.g., sheets of recording paper); an image forming unit 300 that forms images on the surface of the recording sheets S0 that are fed from the sheet storing unit 200 to obtain image-recorded sheets S; the sheet finishing device 1 that collects the image-recorded sheets S and aligns the rear ends of the image-recorded sheets S, and staples the image-recorded sheets S together to form a sheet stack S1; and an image reading unit 400 that optically reads an image from an original and converts the read image information into electric signals. As shown in FIG. 1, the image forming apparatus 100 has a box-like structure in which the sheet storing unit 200, the image forming unit 300, the sheet finishing device 1, and the image reading unit 400 are stacked from bottom to top in that order.

The sheet storing unit 200 includes a sheet storing cassette 201 that is used to store the recording sheets S0 of A3 size and a sheet storing cassette 202 that is used to store the recording sheets S0 of A4 size. Corresponding to each of the sheet storing cassettes 201 and 202 are disposed feeding rollers 42 and separating rollers 45 that feed the topmost recording sheet S0 from the respective sheet storing cassettes. When the recording sheets S0 of A3 size, or A4 size, are selected for image formation by using a sheet selecting switch (not shown), the recording sheets S0 of the selected size are conveyed one by one to the image forming unit 300 through a sheet conveying path 46.

The image forming unit 300 includes an intermediate transfer belt 30 and four image forming units 34Y, 34M, 34C, and 34K. The intermediate transfer belt 30 is an endless belt stretched around a first supporting roller 32*a*, a second supporting roller 32*b*, and a third supporting roller 32*c*. The image forming units 34Y, 34M, 34C, and 34K correspond to yellow (Y) color, magenta (M) color, cyan (C) color, and black (K) color, respectively, and are arranged along the rotation direction of the intermediate transfer belt 30 (indicated by an arrow B). The image forming units 34Y, 34M, 34C, and 34K constitute a tandem image forming mechanism. As described later in detail, single-color toner images in yellow, magenta, cyan, and black colors formed on the image forming units 34Y, 34M, 34C, and 34K, respectively, are sequentially transferred and superimposed on the intermediate transfer belt 30 to form a full-color toner image. Meanwhile, a light exposing unit 35 is disposed beneath the tandem image forming mechanism.

The image forming units 34Y, 34M, 34C, and 34K include photosensitive drums 40Y, 40M, 40C, and 40K, respectively, which rotate in the clockwise direction (shown by arrows) and around which other constituent elements are disposed. That is, each of the image forming units 34Y, 34M, 34C, and 34K includes a charging unit 37 (e.g. a charging roller) that uniformly charges the surface of the corresponding photosensitive drum 40Y, 40M, 40C, or 40K. In addition, the image forming units 34Y, 34M, 34C, and 34K respectively include a developing unit 38Y containing yellow toner, a developing unit 38M containing magenta toner, a developing unit 38C containing cyan toner, and a developing unit 38K containing black toner. The developing units 38Y, 38M, 38C, and 38K transfer the respective toners to the photosensitive drums 40Y, 40M, 40C, and 40K such that electrostatic latent images formed on the surface of the photosensitive drums 40Y, 40M, 40C, and 40K are converted into single-color toner images of respective toner colors. Moreover, each of the image forming units 34Y, 34M, 34C, and 34K includes a drum cleaning unit 39 that, when the single-color toner images are transferred from the photosensitive drums 40Y, 40M, 40C, and 40K on the intermediate transfer belt 30, removes the residual toner from the corresponding photosensitive drum 40Y, 40M, 40C, or 40K.

Meanwhile, on the left side of the second supporting roller 32*b* in FIG. 1 is disposed a belt cleaning unit 33 including a lubricant applying unit (not shown). When a full-color toner image on the intermediate transfer belt 30 is transferred on a recording sheet S0, the belt cleaning unit 33 removes the residual toner from the intermediate transfer belt 30 and the lubricant applying unit applies a lubricant on the surface of the intermediate transfer belt 30.

On the opposite side of the tandem image forming mechanism across the intermediate transfer belt 30 is disposed a secondary transfer mechanism that includes the first supporting roller 32*a* and a secondary transfer roller 36 (secondary transfer member) arranged facing the first supporting roller 32*a*. When a transfer voltage is applied to the secondary transfer roller 36, it transfers the full-color toner image from the intermediate transfer belt 30 on the recording sheet S0 that has been conveyed to the secondary transfer mechanism by a registration roller 49 described later. The image-recorded sheet S with the full-color toner image thereon is then conveyed to a fixing unit 25 in which a pressure roller 27 is pressed against a fixing roller 26 that is an endless belt. The fixing roller 26 heats and softens the full-color toner image on the image-recorded sheet S and the pressure roller 27 applies pressure to fix the toner image on the image-recorded sheet S. Meanwhile, on the right side of the secondary transfer roller 36 and the fixing unit 25 in FIG. 1 is disposed a sheet reversing unit 28 that, when duplex image formation is to be performed, reverses the image-recorded sheet S with the toner image transferred and fixed on one surface thereof. Moreover, the developing units 38Y, 38M, 38C, and 38K are refilled with the yellow toner, the magenta toner, the cyan toner, and the black toner from toner bottles 31Y, 31M, 31C, and 31K, respectively.

Given below is the description of an image forming process performed in the image forming apparatus 100. To obtain a copy of an original from the image forming apparatus 100, first, the original is placed on an exposure glass 20 of the image reading unit 400.

When a start switch (not shown) is pressed, the image reading unit 400 is activated and a first carriage 21 and a second carriage 22 start running. The first carriage 21 includes a light source (not shown) for emitting light to the original and reflects the light reflected from the original toward the second carriage 22. The light further reflects from a mirror (not shown) on the second carriage 22 and falls on a reading sensor 24 via an imaging lens 23. As a result, the contents on the original are read in the form of electric signals, which are then output to the light exposing unit 35. Subsequently, the light exposing unit 35 separates the electric signals into electric signals corresponding to yellow, magenta, cyan, and black colors and irradiates the surfaces of the photosensitive drums 40Y, 40M, 40C, and 40K to exposure light based on the image information corresponding to the respective colors. As a result, electrostatic latent images corresponding to yellow, magenta, cyan, and black colors are formed on the surfaces of the photosensitive drums 40Y, 40M, 40C, and 40K, respectively.

Meanwhile, when the start switch is pressed, a driving motor (not shown) rotates one of the first supporting roller 32*a*, the second supporting roller 32*b*, and the third supporting roller 32*c* as a driving roller. The remaining two supporting rollers rotate as driven rollers. Consequently, the intermediate transfer belt 30 rotates in the counterclockwise direction indicated by the arrow B.

At the same time, the photosensitive drums 40Y, 40M, 40C, and 40K in the image forming units 34Y, 34M, 34C, and 34K, respectively, are rotated in the clockwise direction. Subsequently, the charging unit 37 disposed corresponding to each of the photosensitive drums 40Y, 40M, 40C, and 40K uniformly charges the surface of the corresponding photosensitive drum 40Y, 40M, 40C, or 40K. The uniformly charged surfaces of the photosensitive drums 40Y, 40M, 40C, and 40K are then exposed to laser light corresponding to color images in yellow, magenta, cyan, and black colors, respectively, modulated according to the image information read by the image reading unit 400. As a result, electrostatic latent images corresponding to yellow, magenta, cyan, and black colors are formed on the surfaces of the photosensitive drums 40Y, 40M, 40C, and 40K, respectively.

The developing units 38Y, 38M, 38C, and 38K develop the electrostatic latent images on the photosensitive drums 40Y, 40M, 40C, and 40K into single-color toner images of yellow, magenta, cyan, and black colors by using the yellow toner, the magenta toner, the cyan toner, and the black toner, respectively. A primary transfer roller 62 sequentially transfers each of the four single-color toner images on the rotating intermediate transfer belt 30. The single-color toner images get superimposed on one another on the intermediate transfer belt 30 to form a compound color image (full-color toner image).

Once the single-color toner images are transferred on the intermediate transfer belt 30, the drum cleaning unit 39 removes the residual toner from the corresponding photosensitive drum 40Y, 40M, 40C, or 40K with the use of a cleaning blade and uses a lubricant applying unit to apply a lubricant on the surfaces of the corresponding photosensitive drum 40Y, 40M, 40C, or 40K. Subsequently, the charging unit 37 again uniformly charges the surface of the corresponding photosensitive drum 40Y, 40M, 40C, or 40K. Thus, the photosensitive drums 40Y, 40M, 40C, and 40K become ready for subsequent image formation.

Pressing the start switch also results in selective rotation of the feeding roller 42 in one of the sheet storing cassettes 201 and 202, which are arranged one above another in a paper bank 43. The recording sheets S0 stored in the sheet storing cassette corresponding to the rotating feeding roller 42 are fed. The corresponding separating roller 45 then separates the topmost of the recording sheets S0 and conveys it in the sheet conveying path 46. A conveying roller 47 guides the separated recording sheet S0 to the image forming unit 300. That recording sheet S0 then reaches the registration roller 49, which is not yet rotating, and abuts against it. Thus, the conveyance of the recording sheet S0 comes to a temporary halt.

In the case of using a manual feeding tray 51, a feeding roller 50 rotates to feed the recording sheets S0 from the manual feeding tray 51. A separating roller (not shown) separates the topmost of the recording sheets S0 and guides it in a manual sheet conveying path (not shown). The guided recording sheet S0 also reaches the registration roller 49 and abuts against it. Thus, the conveyance of the recording sheet S0 comes to a temporary halt.

The registration roller 49 starts rotating at a timing when the compound color image formed on the intermediate transfer belt 30 reaches the secondary transfer mechanism. Consequently, the recording sheet S0 is conveyed through a nip formed between the intermediate transfer belt 30 and the secondary transfer roller 36 and the compound color image is transferred on the recording sheet S0.

The image-recorded sheet S (i.e., the recording sheet S0 with the compound color image transferred thereon) is conveyed to the fixing unit 25, which applies heat and pressure to fix the transferred image on the image-recorded sheet S. Then, a switching claw 55 selects a conveying path in which a discharging roller 56 discharges the image-recorded sheet S to the sheet finishing device 1. Meanwhile, for duplex image formation, the switching claw 55 selects a conveying path in which the image-recorded sheet S is conveyed to the sheet reversing unit 28. Subsequently, the sheet reversing unit 28 reverses the image-recorded sheet S and guides it to the secondary transfer position such that an image is transferred on the reverse side of the image-recorded sheet S. The discharging roller 56 then discharges the image-recorded sheet S with images formed on both sides thereof to the sheet finishing device 1.

Meanwhile, although the image forming apparatus 100 is described to perform image formation by electrophotographic technology with the use of toners, it is also possible to configure the image forming apparatus 100 to perform image formation by inkjet printing with the use of liquid ink of each color.

The sheet finishing device 1 includes the aligning unit 2 that collects a plurality of the image-recorded sheets S discharged by the discharging roller 56 and aligns the rear ends Sb of the image-recorded sheets S, a stapling unit 6 that staples the aligned rear ends Sb of the image-recorded sheets S to form the sheet stack S1, and the collecting tray 3 for stacking the stapled sheet stack S1.

The description of the sheet finishing device 1 according to the first embodiment is given with reference to FIGS. 2 to 5.

Figure 2:
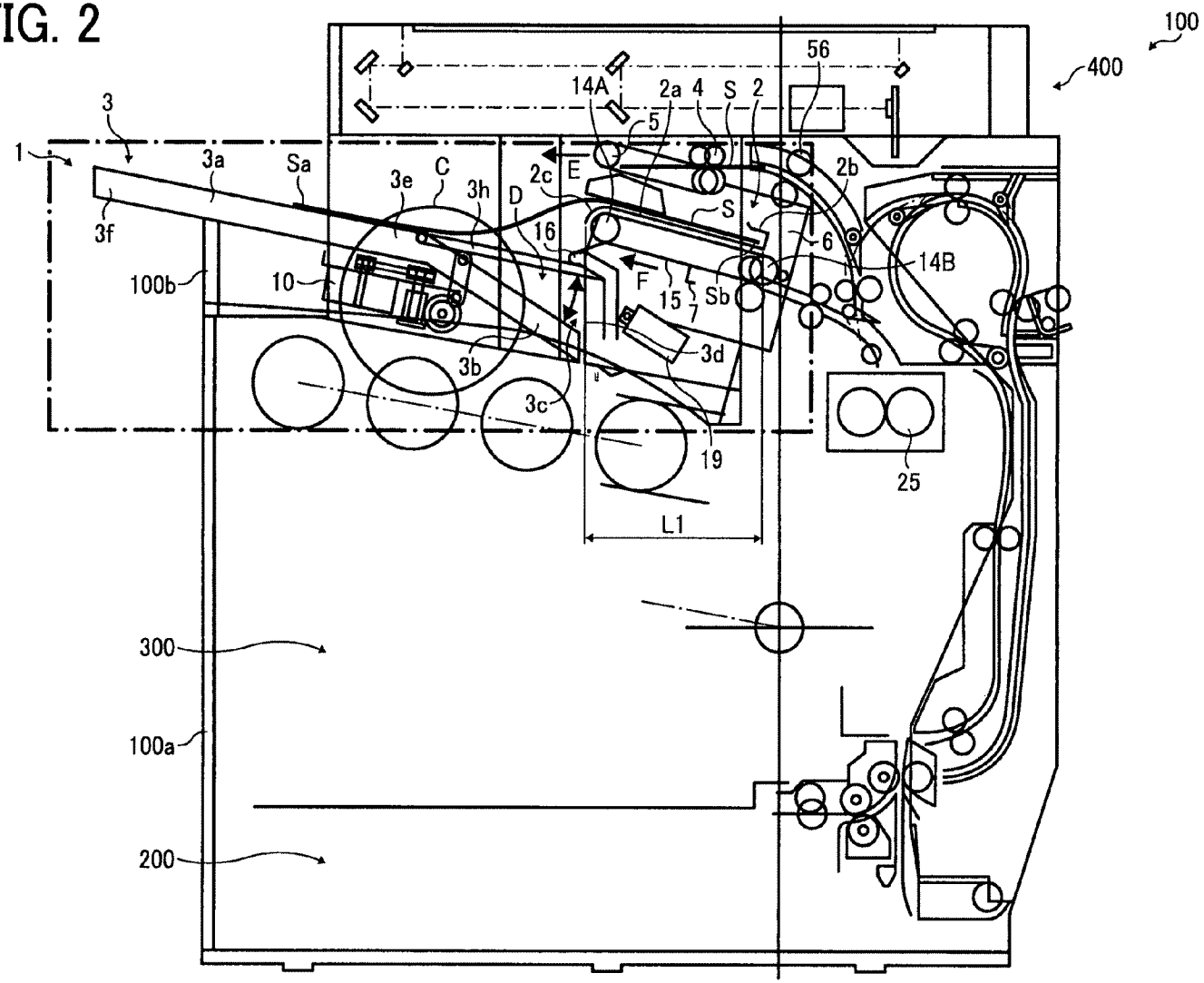
FIG. 2 is a schematic diagram of a state where a sheet finishing device according to the first embodiment is installed inside the image forming apparatus shown in FIG. 1.
Figure 3:
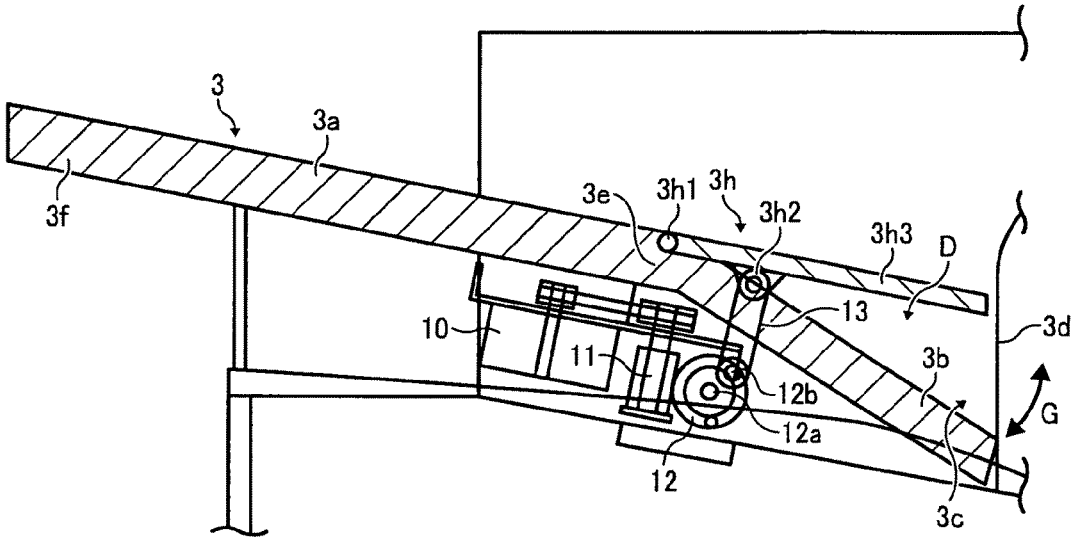
FIG. 3 is an enlarged view of a portion C shown in FIG. 2 depicting the sheet finishing device according to the first embodiment.
Figure 4:
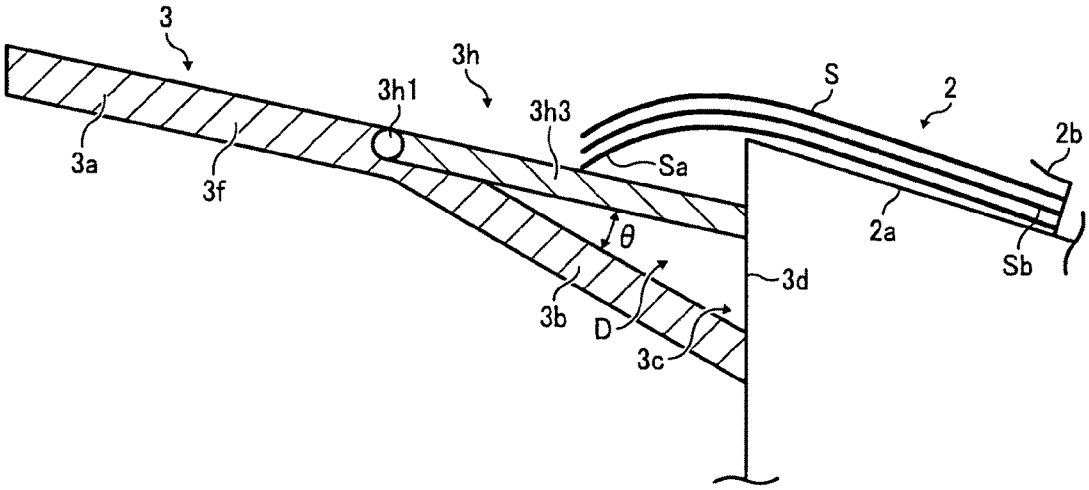
FIG. 4 is a schematic diagram for explaining a state where rear ends of recording sheets have been aligned by an aligning unit in the sheet finishing device shown in FIG. 2.

FIG. 2 is a schematic diagram of a state where the sheet finishing device 1 is installed inside the image forming apparatus 100. FIG. 3 is an enlarged view of a portion C shown in FIG. 2 to depict the sheet finishing device 1. FIG. 4 is a schematic diagram for explaining alignment of the rear ends Sb of the image-recorded sheets S by the aligning unit 2.

As shown in FIG. 2, the sheet finishing device 1 includes the conveying roller 4 that conveys, in substantially horizontal direction, the image-recorded sheets S discharged by the discharging roller 56 into the sheet finishing device 1 from the upper part thereof. The aligning unit 2 and the collecting tray 3 are disposed substantially parallel to a conveying direction E in which the image-recorded sheets S are conveyed inside the sheet finishing device 1. Such a configuration enables achieving compactness in the height direction of the sheet finishing device 1 and enables proper installation of the sheet finishing device 1 within a space between the image forming unit 300 and the image reading unit 400. That allows manufacturing of a compact image forming apparatus 100 having smaller installation area.

As described above, the conveying roller 4 conveys the image-recorded sheets S discharged by the discharging roller 56 into the sheet finishing device 1 in substantially horizontal direction. When the rear end Sb of a image-recorded sheet S rolls by the conveying roller 4, a reverse rotating roller 5 reverses the image-recorded sheet S so that the rear end Sb thereof becomes the front end and conveys the reversed image-recorded sheet S to the rear end referencing members 2*b* disposed in plurality in the aligning unit 2. Thus, the rear end Sb of the image-recorded sheet S abuts against the rear end referencing members 2*b*, which are spaced apart along the width direction of the image-recorded sheets S. In this way, the aligning unit 2 collects all of the image-recorded sheets S and aligns the rear ends Sb thereof.

When the rear ends Sb of a few image-recorded sheets S are aligned at the rear end referencing members 2*b*, the stapling unit 6 disposed adjacent to the rear end referencing members 2*b* staples the aligned rear ends Sb to form the sheet stack S1. Subsequently, a discharging claw 7 that is attached to an endless conveying belt 15 conveys the stapled sheet stack S1 in the direction of an arrow F. The conveying belt 15 is stretched around supporting rollers 14B and 14B and rotates by the rotation of the supporting rollers 14A and 14B.

The discharging claw 7 conveys the sheet stack S1 to the supporting surface 3*a* in the collecting tray 3. More particularly, as the conveying belt 15 rotates, the discharging claw 7 slides under the sheet stack S1 resting on the supporting surface 2*a* of the aligning unit 2 and conveys it to the supporting surface 3*a* of the collecting tray 3. At that time, a rear end S1*b* of the sheet stack S1 drops into the bottom portion 3*c* in the collecting tray 3. The bottom portion 3*c* is situated at a lower level having the space D from an end edge 2*c* of the supporting surface 2*a*. Upon being dropped into the bottom portion 3*c* in the collecting tray 3, the sheet stack S1 abuts against the regulating fence 3*d* along the inclined surface 3*b* and rests in alignment at the regulating fence 3*d*.

In this way, in the sheet finishing device 1, the aligning unit 2 collects a few image-recorded sheets S and aligns the rear ends Sb thereof and the stapling unit 6 staples the aligned rear ends Sb to form the sheet stack S1. Then, the sheet stack S1 is collected in the collecting tray 3. To downsize the sheet finishing device 1, the length L1 from the end edge 2*c* of the supporting surface 2*a*, which supports the image-recorded sheets S in the aligning unit 2, to the rear end referencing members 2*b* is kept shorter than the length of the image-recorded sheets S along the conveying direction (see FIG. 2). Moreover, to collect and align the sheet stack S1 in the bottom portion 3*c* of the collecting tray 3, the space D is formed between a bending member 3*e* in the collecting tray 3 and the end edge 2*c* of the supporting surface 2*a* of the aligning unit 2. The bending member 3*e* has a surface that makes an angle with respect to the supporting surface 3*a* to form the inclined surface 3*b* that is inclined more than the supporting surface 3*a*.

Figure 12:
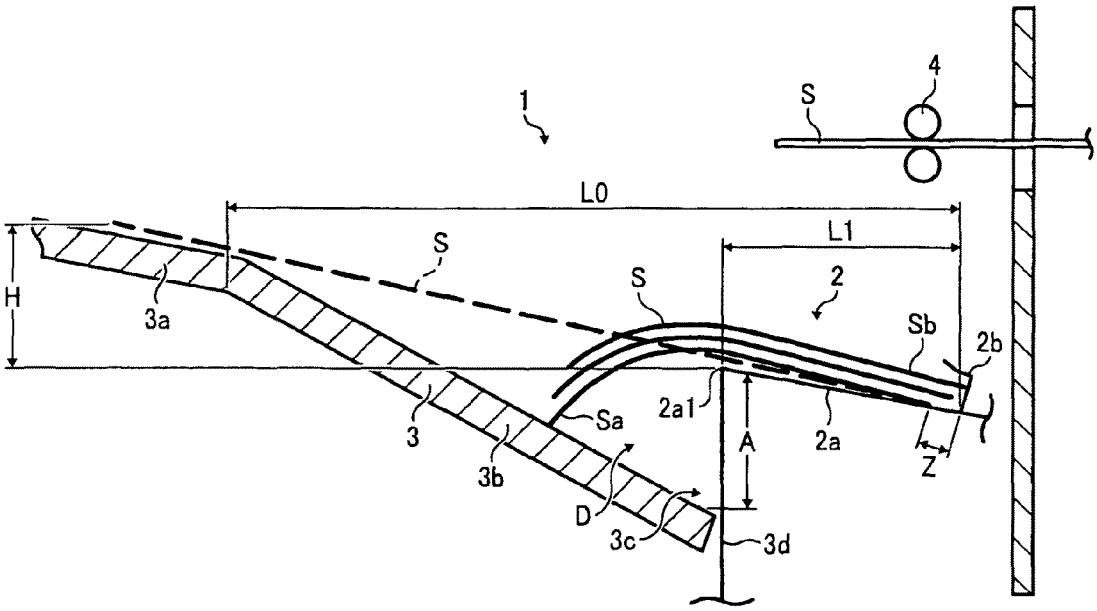
FIG. 12 is a schematic diagram of a configuration of a conventional sheet finishing device.

In comparison, consider the conventional configuration shown in FIG. 12. That is, consider the abovementioned case when the collected image-recorded sheets S that are shorter in length than the length L0 from the rear end referencing members 2*b* to the supporting surface 3*a* of the collecting tray 3 are aligned and positioned at the rear end referencing members 2*b*. As shown in FIG. 12, because the length L1 from the rear end referencing members 2*b* to the end edge 2*a*1 of the supporting surface 2*a* is shorter than the length of the image-recorded sheets S, the front ends Sa of the image-recorded sheets S hang loose in the space D. That causes the misalignment Z in the rear ends Sb of the image-recorded sheets S having been aligned at the rear end referencing members 2*b*. As a result, it becomes likely that stapling is performed with the rear ends Sb out of alignment.

To solve such a problem, the collecting tray 3 according to the first embodiment includes a fixed collecting member 3*f* and a movable supporting member 3*h* as shown in FIG. 3. The fixed collecting member 3*f* includes the supporting surface 3*a* and the inclined surface 3*b* and is attached to a supporting member 100*b* (see FIG. 2) that in turn is coupled with a frame 100*a* of the image forming apparatus 100. A front portion 3*h*3 of the movable supporting member 3*h* is rotatably attached to the bending member 3*e*, which is situated intermediately on the fixed collecting member 3*f*, by a base member 3*h*1. A coupling member 3*h*2 of the movable supporting member 3*h* is so coupled with a cam member 12 by a link 13 that the rotation of the cam member 12 enables up-and-down movement of the front portion 3*h*3 along the direction of an arrow G. Thus, by rotatably holding the front portion 3*h*3 to the bending member 3*e* with the base member 3*h*1, the front portion 3*h*3 can move closer to or far from the image-recorded sheets S.

The cam member 12 engages with a gear row 11 that is rotated by the rotation of a driving motor 10. Thus, the cam member 12 also rotates by the rotation of the driving motor 10 around a rotating shaft 12*a*. Due to the rotation of the cam member 12, the link 13, which engages with a protrusion 12*b* biased from the rotating shaft 12*a*, moves up and down. That enables the front portion 3*h*3 of the movable supporting member 3*h* to move up and down.

As described above, the rear ends Sb of the collected image-recorded sheets S abut against the rear end referencing members 2*b* of the aligning unit 2 for alignment and positioning. However, at times, there is a possibility that the front ends Sa of the collected image-recorded sheets S hang loose in the space D thereby causing position misalignment in the aligned rear ends Sb.

To prevent such position misalignment, the front portion 3*h*3 of the movable supporting member 3*h* is moved upward to close the space D at the time when the aligning unit 2 collects and aligns the image-recorded sheets S (see FIG. 4). Moreover, the front portion 3*h*3 abuts against the front ends Sa of the image-recorded sheets S such that the front ends Sa do not hang loose in the space D. That prevents position misalignment of the rear ends Sb at the rear end referencing members 2*b*. Thus, the rear ends Sb of the image-recorded sheets S are maintained in alignment before being stapled as the sheet stack S1.

In this case, moving the front portion 3*h*3 of the movable supporting member 3*h* upward by about a rotating angle θ (see FIG. 4) is sufficient to prevent the front ends Sa from hanging loose in the space D and to prevent position misalignment in the rear ends Sb at the rear end referencing members 2*b*. However, if the rotating angle θ is large, then there is a possibility that the rear ends Sb of the image-recorded sheets S are not properly held in a sheet-end holding unit (not shown) of the stapling unit 6. Thus, it is desirable to set the rotating angle θ to such a value that the sheet-end holding unit of the stapling unit 6 and the topmost of the collected image-recorded sheets S are maintained at an even height.

For that, it is desirable that, depending on the number of image-recorded sheets S collected at the rear end referencing members 2*b*, the movement of the driving motor 10 is controlled to move down the front portion 3*h*3 such that the top surface of the image-recorded sheets S is maintained at a flat level. That ensures reliable stapling of the rear end of the sheet stack S1 by the stapling unit 6.

Thus, after the aligning unit 2 collects and aligns the image-recorded sheets S and the stapling unit 6 staples the image-recorded sheets S to obtain the sheet stack S1, the sheet stack S1 is collected in the bottom portion 3*c* of the collecting tray 3. For that, the driving motor 10 is moved in such a way that the front portion 3*h*3 of the movable supporting member 3*h* moves downward and fits in the inclined surface 3*b*. That ensures reliable collection of the stapled sheet stack S1 in the bottom portion 3*c* of the collecting tray 3.

Moreover, while the staple sheet stack S1 is being discharged to the collecting tray 3, the front portion 3*h*3 of the movable supporting member 3*h* is not moved to fit in the inclined surface 3*b* but is maintained at a flat level with respect to the supporting surface 3*a* of the collecting tray 3. That prevents development of folds in the sheet stack S1 when being discharged to the collecting tray 3. In comparison, as shown in the conventional configuration in FIG. 12, if the front portion 3*h*3 fits in the inclined surface 3*b*, then the level difference A in the space D increases. Thus, while the stapled sheet stack S1 is being discharged to the collecting tray 3, the rear end of the sheet stack S1 forcefully abuts against the regulating fence 3*d*. As a result, there is a possibility that folds develop at the rear end of the sheet stack S1.

Figure 5:
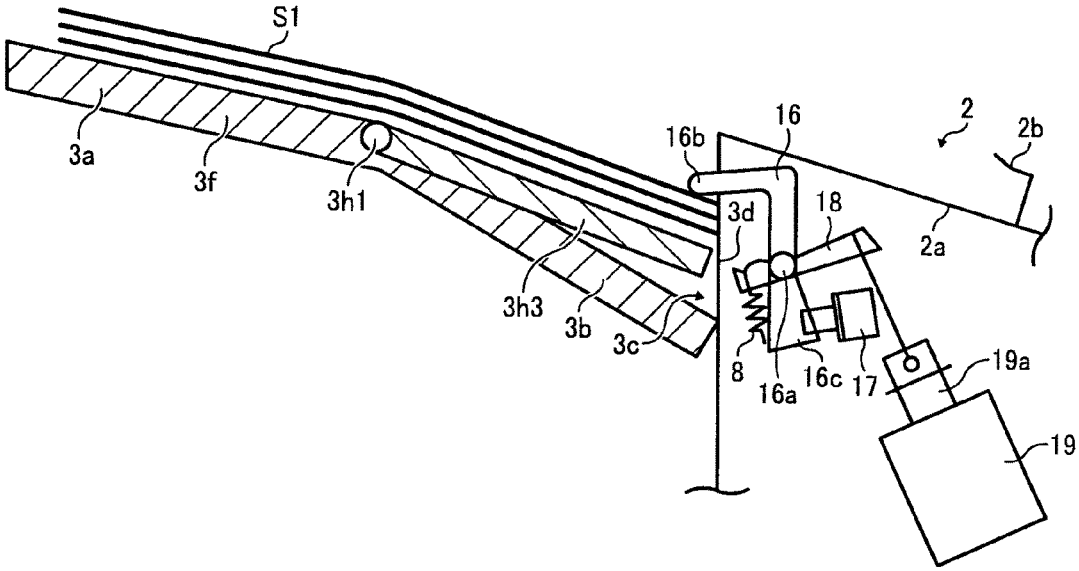
FIG. 5 is a schematic diagram of an exemplary configuration of a detecting unit that detects the thickness of a sheet stack collected in the sheet feeding device shown in FIG. 2.

To prevent such a situation, the front portion 3*h*3 according to the first embodiment is moved upward to ease up the force of the contact between the rear end of the sheet stack S1 and the regulating fence 3*d*. More particularly, as shown in FIG. 5, a sheet height detecting lever 16 is disposed to detect the height of the top surface of the sheet stack S1 that rests on the front portion 3*h*3 and, depending on that height, the driving motor 10 is controlled to vary the rotating angle θ in such a way that the sheet stack S1 resting on the front portion 3*h*3 is maintained at a flat level.

The sheet height detecting lever 16 is rotatably disposed around a middle fulcrum 16*a* and has a tip 16*b* that is protrudable from the regulating fence 3*d*. A sensor 17 is disposed to detect the amount of movement of a detector 16*c* that forms the other end of the sheet height detecting lever 16.

An actuating lever 18 is coupled with the fulcrum 16*a* in an intersecting manner with respect to the sheet height detecting lever 16. One end of the actuating lever 18 is latched to a tension spring 8 that biases the sheet height detecting lever 16 such that the tip 16*b* protrudes through the regulating fence 3*d*. The other end of the actuating level is coupled with a plunger 19*a* of a solenoid mechanism 19. The ON operation of the solenoid mechanism 19 acts against the biasing force of the tension spring 8 such that the tip 16*b* of the sheet height detecting lever 16 is pulled inside the regulating fence 3*d*. Conversely, the OFF operation of the solenoid mechanism 19 causes the tension spring 8 to bias the tip 16*b* of the sheet height detecting lever 16. Thus, the tip 16*b* protrudes through the regulating fence 3*d* and abuts against the top surface of the sheet stack S1.

The tip 16*b* moves up and down depending on the thickness of the sheet stack S1 resting on the front portion 3*h*3 of the movable supporting member 3*h*. The sensor 17 detects the amount of movement of the detector 16*c* caused due to the up-and-down movement of the tip 16*b* and calculates the thickness of the sheet stack S1 placed on the front portion 3*h*3 by using the detected amount of movement. Depending on that thickness, the driving motor 10 is controlled to vary the rotating angle θ for the front portion 3*h*3.

When the sheet stack S1 is being discharged to the front portion 3*h*3 of the movable supporting member 3*h*, the solenoid mechanism 19 performs the ON operation and the tip 16*b* of the sheet height detecting lever 16 is pulled inside the regulating fence 3*d*. Once the rear end of the sheet stack S1 abuts against the regulating fence 3*d*, the solenoid mechanism 19 performs the OFF operation upon which the thickness of the collected sheet stack S1 is detected.

Meanwhile, the movable supporting member 3*h* according to the first embodiment can also prevent curling of the front ends Sa of the image-recorded sheets S when the image-recorded sheets S are discharged into the sheet finishing device 1 from the image forming unit 300 by the conveying roller 4.

Figure 6:
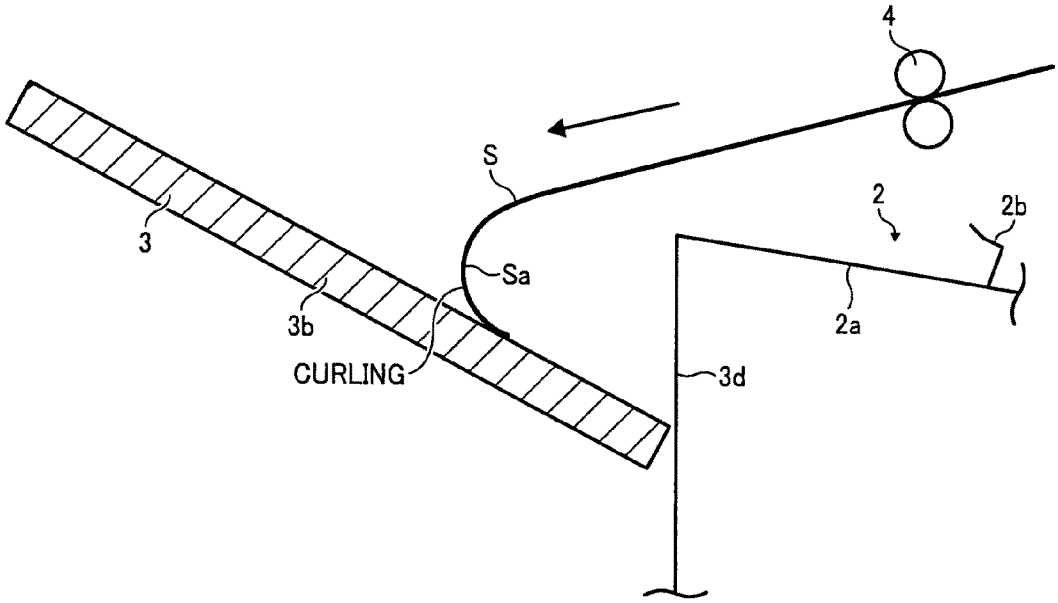
FIG. 6 is a schematic diagram for explaining curling of the front end of a recording sheet that happens in a conventional sheet finishing device.

In a conventional sheet finishing device without the movable supporting member 3*h* as shown in FIG. 6, the front ends Sa of the image-recorded sheets S, which are discharged into the sheet finishing device from the image forming unit 300 by the conveying roller 4, abuts against the inclined surface 3*b* of the collecting tray 3. That sometimes causes curling of the front ends Sa of the image-recorded sheets S. As a result, it becomes difficult for the aligning unit 2 to accurately align the rear ends Sb of the image-recorded sheets S. In comparison, in the sheet finishing device 1, the front portion 3*h*3 of the movable supporting member 3*h* is moved to close the space D as shown in FIG. 4. Consequently, the front ends Sa of the image-recorded sheets S abut against the front portion 3*h*3 of the movable supporting member 3*h* thereby preventing curling of the front ends Sa.

In the first embodiment the front portion 3*h*3 of the movable supporting member 3*h* is disposed to rotate upstream of the conveying direction of the sheet stack S1. In comparison, in a second embodiment of the present invention explained below with reference to FIGS. 7 to 9, the front portion 3*h*3 of the movable supporting member 3*h* is disposed to rotate downstream of the conveying direction of the sheet stack S1.

Figure 7:
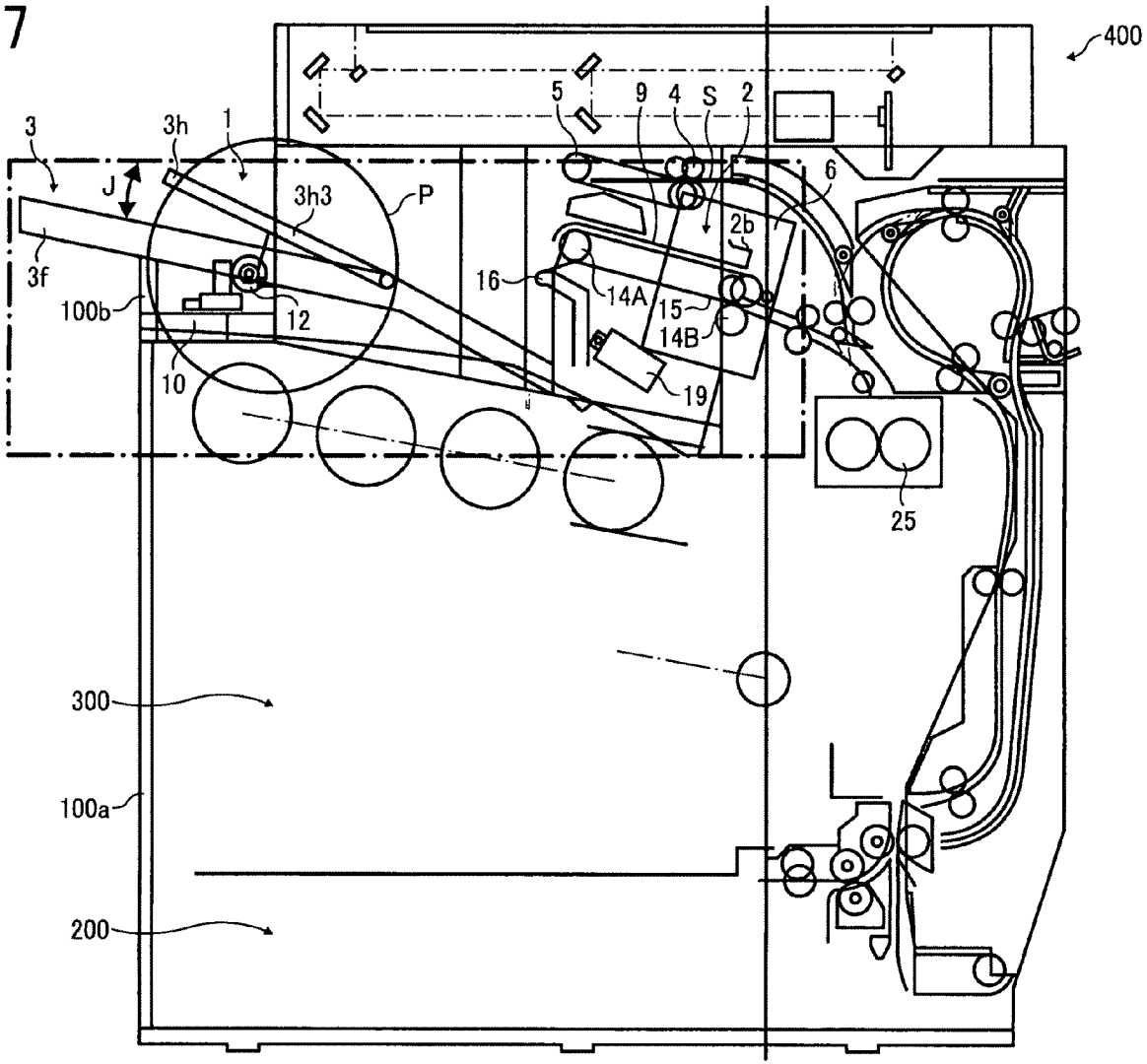
FIG. 7 is a schematic diagram of a state where a sheet finishing device according to a second embodiment of the present invention is installed inside the image forming apparatus shown in FIG. 1.
Figure 8:
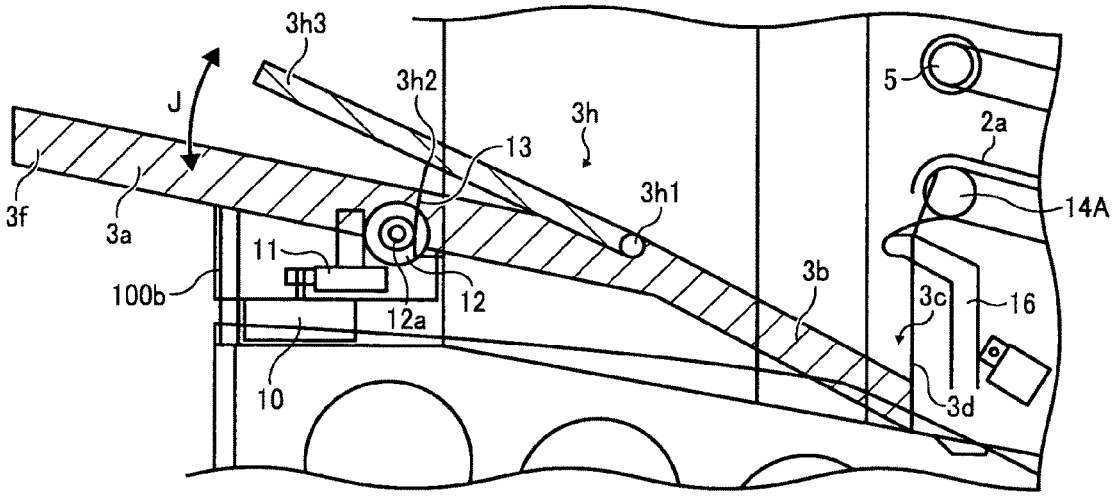
FIG. 8 is an enlarged view of a portion P shown in FIG. 7 depicting the sheet finishing device according to the second embodiment.
Figure 9:
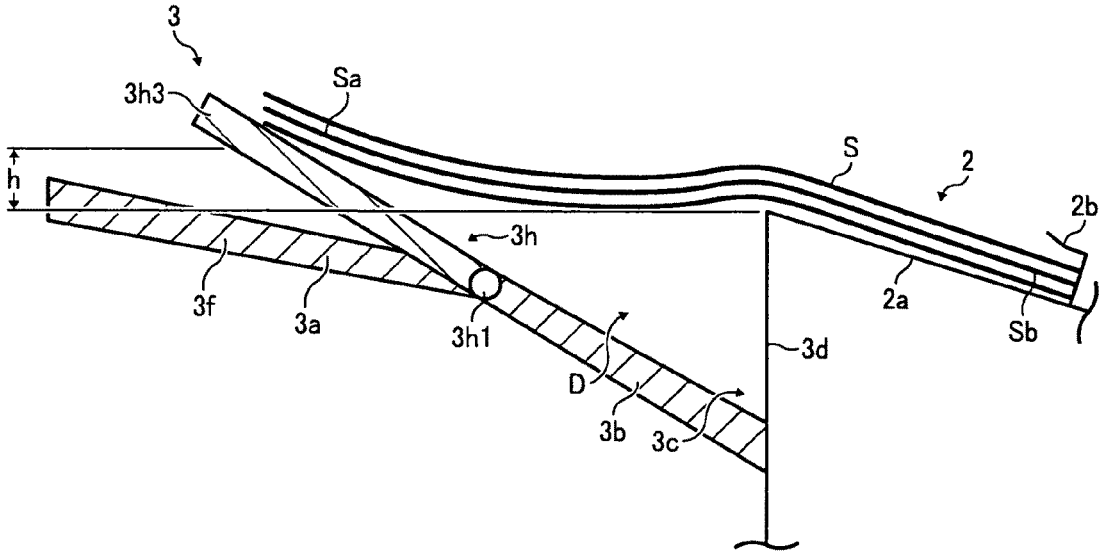
FIG. 9 is a schematic diagram for explaining the movement of a movable supporting member according to the second embodiment.

FIG. 7 is a schematic diagram of a state where a sheet finishing device 1 according to the second embodiment is installed in the image forming apparatus 100. FIG. 8 is an enlarged view of a portion P shown in FIG. 7 depicting the sheet finishing device 1 according to the second embodiment. FIG. 9 is a schematic diagram for explaining the movement of the movable supporting member 3*h* according to the second embodiment.

In the sheet finishing device 1 according to the first embodiment, the front portion 3*h*3 of the movable supporting member 3*h* is disposed to rotate upstream of the conveying direction of the sheet stack S1. In comparison, in the sheet finishing device 1 according to the second embodiment, the front portion 3*h*3 of the movable supporting member 3*h* is disposed to rotate downstream of the conveying direction of the sheet stack S1 (see FIG. 7). As shown in FIG. 8, the sheet finishing device 1 according to the second embodiment includes the movable supporting member 3*h* that is identical to that described in the first embodiment. The front portion 3*h*3 of the movable supporting member 3*h* is rotatably attached to the intermediate section of the fixed collecting member 3*f* by the base member 3*h*1. Moreover, the coupling member 3*h*2 of the movable supporting member 3*h* is so coupled with the cam member 12 by the link 13 that the rotation of the cam member 12 enables up-and-down movement of the front portion 3*h*3 along the direction of an arrow J.

The cam member 12 engages with the gear row 11 that is rotated by the rotation of the driving motor 10. Thus, the cam member 12 also rotates by the rotation of the driving motor 10 around the rotating shaft 12*a*. Due to the rotation of the cam member 12, the link 13, which engages with the protrusion 12*b* biased from the rotating shaft 12*a*, moves up and down. That enables the front portion 3*h*3 of the movable supporting member 3*h* to move up and down.

Unlike in the sheet finishing device 1 according to the first embodiment, the movable supporting member 3*h* according to the second embodiment is disposed downstream of the conveying direction of the sheet stack S1 and the front portion 3*h*3 of the movable supporting member 3*h* can move up and down above the supporting surface 3*a* of the collecting tray 3. At the time of sheet alignment, the front ends Sa of the image-recorded sheets S abut against the front portion 3*h*3 (see FIG. 9) and is elevated by a height h from the supporting surface 2*a* of the aligning unit 2. Consequently, the weight of the image-recorded sheets S pushes the rear ends Sb against the rear end referencing members 2*b* to rest in alignment. Such a configuration is particularly effective when the length of the image-recorded sheets S exceeds the space D in the collecting tray 3.

Meanwhile, it is also possible to dispose two cam members 12 to move the front portion 3*h*3 of the movable supporting member 3*h*. In that case, one of the cam members 12 can be used, when the image-recorded sheets S are shorter in length than the space D, to move the front portion 3*h*3 up and down along the direction of the arrow G such that the space D is closed (see FIG. 3). On the other hand, for the image-recorded sheets S exceeding the space D in length, the other cam member 12 can be linked to the link 13 such that the front portion 3*h*3 is reversed and moves up and down above the supporting surface 3*a* of the collecting tray 3. Such a configuration enables to tackle the image-recorded sheets S of various sizes. Moreover, it is also possible, and preferable, to simultaneously and independently dispose the movable supporting member 3*h* according to the first embodiment and the movable supporting member 3*h* according to the second embodiment such that it is possible to properly align the image-recorded sheets S of various sizes.

Given below is the description according to a third embodiment of the present invention.

If large-sized image-recorded sheets S longer than the length of the collecting tray 3 along the conveying direction are collected, then there is a possibility that the front ends Sa of the image-recorded sheets S hang loose from the collecting tray 3 thereby causing misalignment in the rear ends Sb or causing the image-recorded sheets S to fall off the collecting tray 3. To prevent such a situation, sometimes an auxiliary tray is disposed to extend the collecting tray 3 as necessary.

Figure 13:
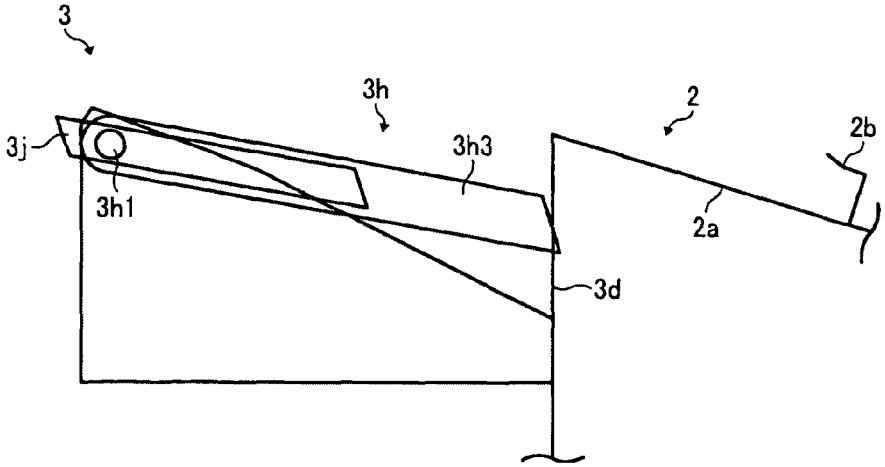
FIG. 13 is a schematic diagram of a conventional sheet finishing device including an auxiliary tray.
Figure 14:
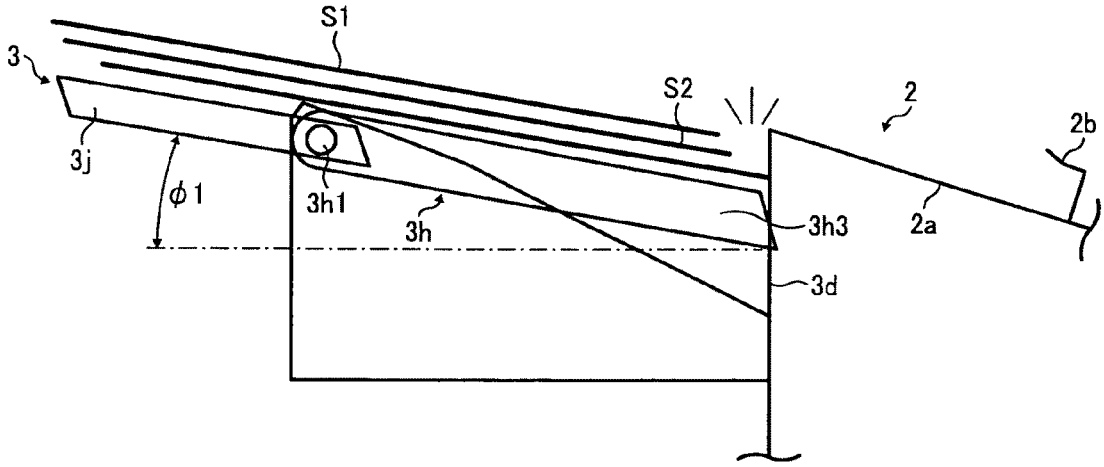
FIGS. 14 and 15 are schematic diagrams for explaining alignment of sheets in the conventional sheet finishing device shown in FIG. 13.
Figure 15:
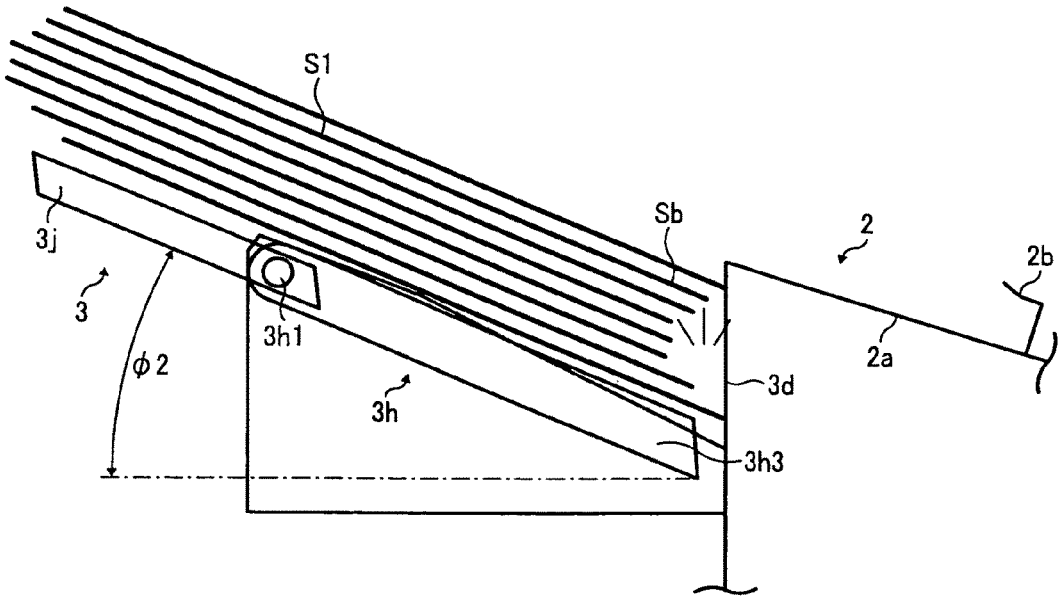

For example, Japanese Patent Application Laid-open No. 2008-7305 discloses a collecting tray having a rotation center at one end to maintain a constant position of the top surface of the recording sheets at the side of a sheet finishing mechanism. FIGS. 13 to 15 are schematic diagrams for explaining a configuration of the collecting tray 3 that is identical to the configuration disclosed in Japanese Patent Application Laid-open No. 2008-7305 and that includes an auxiliary tray 3*j* attached to the movable supporting member 3*h*.

With reference to the conventional configuration in FIGS. 13 to 15, because the auxiliary tray 3*j* is attached to the movable supporting member 3*h*, the angle of the auxiliary tray 3*j* varies by the rotation of the movable supporting member 3*h*. As shown in FIG. 14, when only a few image-recorded sheets S are collected in the collecting tray 3, an elevation angle $\phi$1 of the movable supporting member 3*h* and the auxiliary tray 3*j* is small. In that case, the weight of the collected image-recorded sheets S is not sufficient to push the rear ends Sb against the regulating fence 3*d* thereby causing misalignment in the collected image-recorded sheets S. On the other hand, consider a case when a large number of the image-recorded sheets S are collected in the collecting tray 3 such that an elevation angle $\phi$2 of the movable supporting member 3*h* and the auxiliary tray 3*j* is also large (see FIG. 15). However, even in that case, the rear ends Sb that have not yet abutted against the regulating fence 3*d* do not move toward the regulating fence 3*d*. Moreover, more image-recorded sheets S get collected on top of the already-collected image-recorded sheets S. That causes misalignment in the collected image-recorded sheets S.

Figure 10:
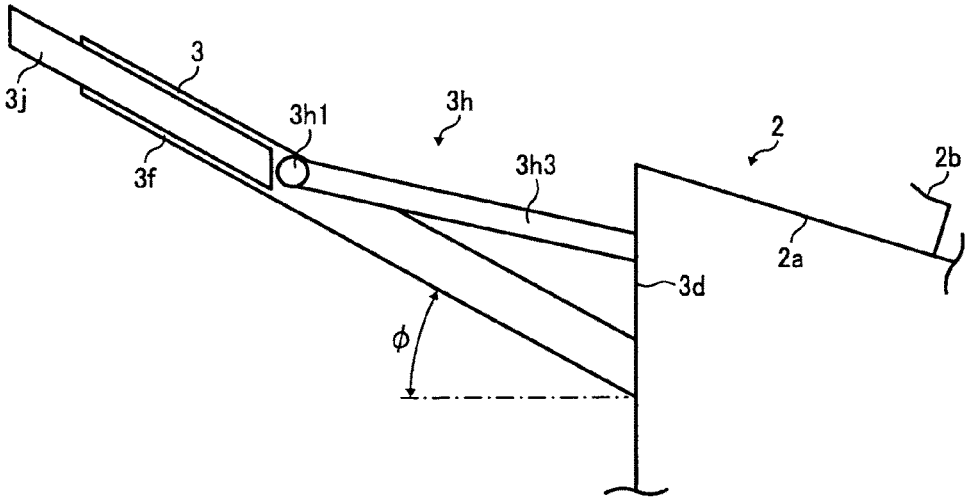
FIGS. 10 and 11 are schematic diagrams of an exemplary configuration of a sheet finishing device according to a third embodiment of the present invention.

To take care of such problems, the feature of the sheet finishing device 1 according to the third embodiment is that the auxiliary tray 3*j* is attached to the fixed collecting member 3*f* in such a way that the collecting tray 3 can be extended along the conveying direction of the image-recorded sheets S (see FIG. 10).

More particularly, in the collecting tray 3 according to the third embodiment, the base member 3*h*1 of the movable supporting member 3*h* is fixed at the intermediate portion on the fixed collecting member 3*f* such that the front portion 3*h*3, which is situated at the upstream side of the conveying direction as compared to the base member 3*h*1, can move up and down (move closer to or far from the image-recorded sheets S). The auxiliary tray 3*j* is so attached to the fixed collecting member 3*f* that it can advance from or reverse into the fixed collecting member 3*f* along the conveying direction of the image-recorded sheets S. As a result, the collecting tray 3 becomes extendable toward the downstream side of the conveying direction from the fixed collecting member 3*f*. When not in use, the auxiliary tray 3*j* can be housed in part or in whole into the fixed collecting member 3*f*.

Figure 11:
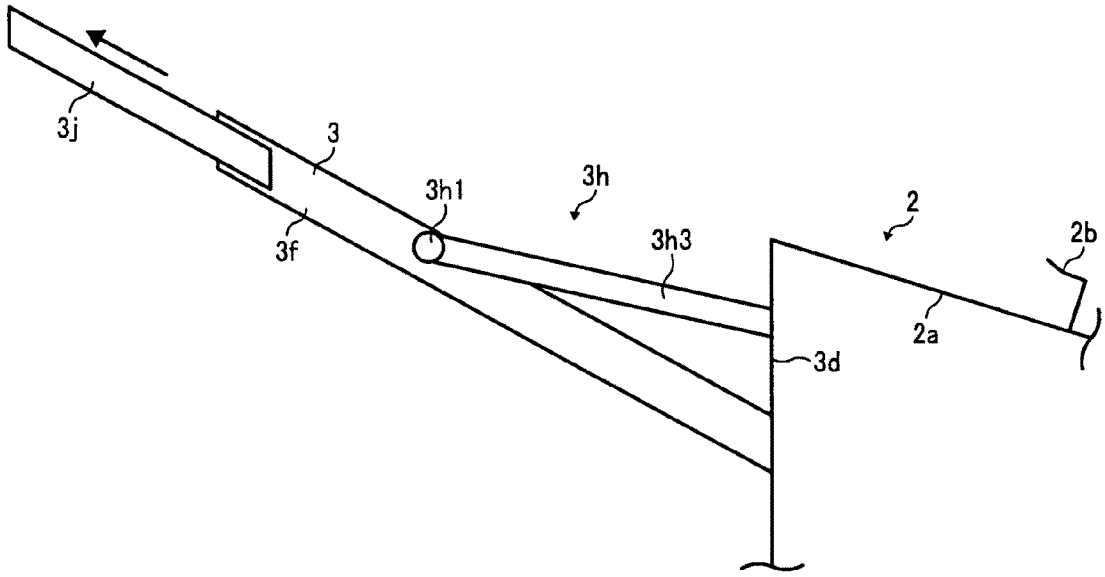

Consider a case when the fixed collecting member 3*f* is meant to collect the image-recorded sheets S only up to A4 size and it is required to collect large-sized image-recorded sheets S of, for example, A3 size or B4 size. In that case, as shown in FIG. 11, the auxiliary tray 3*j* is pulled out manually such that the fixed collecting member 3*f* gets extended. Thus, it becomes possible to increase the collectable size in the collecting tray 3 as necessary.

As described above, because the auxiliary tray 3*j* is attached to the fixed collecting member 3*f* to enable collection of the large-sized image-recorded sheets S, an elevation angle $\phi$ of the fixed collecting member 3*f* and the auxiliary tray 3*j* (see FIG. 10) does not decrease irrespective of the angle of the movable supporting member 3*h* (irrespective of the number of collected image-recorded sheets S). As a result, it becomes possible to maintain the image-recorded sheets S in alignment.

In this way, according to an aspect of the present invention, it is possible to properly align the rear ends of recording sheets of various sizes. Moreover, it is also possible to manufacture a compact sheet finishing device that can be suitably installed inside an image forming apparatus as well as manufacture an image forming apparatus that includes the compact sheet finishing device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet finishing device comprising:

an aligning unit that collects a recording sheet on which an image forming unit has formed an image and aligns rear end of the recording sheet, the aligning unit having a sheet supporting surface that is shorter in length than a length of the recording sheet in a conveying direction; and a collecting tray in which the recording sheet aligned by the aligning unit is collected, the collecting tray including a fixed collecting member that collects and houses the recording sheet in a bottom portion thereof having a level difference in the conveying direction with respect to the sheet supporting surface of the aligning unit; and a movable supporting member that is rotatably attached to an intermediate portion of the fixed collecting member along the conveying direction by a base member such that a front portion of the movable supporting member is able to move closer to or far from the recording sheet, wherein when the aligning unit collects the recording sheet, the front portion of the movable supporting member rotates toward the recording sheet and abuts against a front portion of the recording sheet to control position of the rear end of the recording sheet in the aligning unit.

2. The sheet finishing device according to claim 1, wherein the front portion of the movable supporting member rotates up and down at upstream side of the conveying direction.

3. The sheet finishing device according to claim 2, wherein the movable supporting member is so configured that a height of the front portion thereof changes according to a number of the recording sheets collected by the aligning unit.

4. The sheet finishing device according to claim 1, wherein the front portion of the movable supporting member rotates up and down at downstream side of the conveying direction.

5. The sheet finishing device according to claim 2, wherein the fixed collecting member includes an auxiliary tray that is extendable toward a downstream side of the conveying direction.

6. An image forming apparatus comprising:

an image forming unit that forms an image on a recording sheet; and a sheet finishing device that performs finishing processing on the recording sheet, wherein the sheet finishing device is the sheet finishing device according to claim 1.

7. The image forming apparatus according to claim 6, further comprising an image reading unit that acquires image data by optically scanning the original image, wherein the image forming unit forms the image on the recording sheet by using the image data read by the image reading unit.

8. A sheet finishing device comprising:

an aligning unit configured to receive a recording sheet one by one from an image forming unit and to align rear ends of the recording sheets to make a sheet stack, the aligning unit having a sheet supporting surface that is shorter in length than a shortest length of a smallest handelable paper of the recording sheet in a conveying direction of the recording sheets; and a collecting unit configured to receive the sheet stack from the aligning unit, the collecting unit including a fixed member arranged in a fixed manner relative to the sheet supporting surface of the aligning unit, the fixed member having a first portion located toward the aligning unit and a second portion located away from the aligning unit, the fixed member configured to collect the sheet stack in the first portion, an end of the first portion located toward the aligning unit being situated at a lower level with respect to the sheet supporting surface in the conveying direction; and a rotational member having a rotatably-fixed end and a free end, the rotatably-fixed end being rotatably attached to the fixed member at a junction of the first portion and the second portion with a rotational axis perpendicular to the conveying direction so that the free end rotates freely in the conveying direction; and a rotation control unit that controls rotation of rotational member, wherein, when a sheet stack is present on the sheet supporting surface of the aligning unit, the rotation control unit causes the rotational member to rotate so that the free end lifts up a hanging end of the sheet stack.

9. The sheet finishing device according to claim 8, wherein the free end of the rotational member rotates in an area that is upstream of the rotational axis in the conveying direction.

10. The sheet finishing device according to claim 9, wherein the rotation control unit adjusts an angle of rotation of the rotational member based on number of sheets in the sheet stack that is present on the sheet supporting surface.

11. The sheet finishing device according to claim 8, wherein the free end of the rotational member rotates in an area that is downstream of the rotational axis in the conveying direction.

12. The sheet finishing device according to claim 9, wherein the fixed member includes an auxiliary extendable tray arranged at the second portion.

13. The sheet finishing device according to claim 8, wherein the first portion and the second portion of the fixed member are inclined with respect to each other.

14. The sheet finishing device according to claim 8, further comprising a processing unit that performs certain processing on the sheet stack present on the sheet supporting surface.

15. The sheet finishing device according to claim 14, wherein the processing unit is a stapling unit that staples the sheet stack.

16. The sheet finishing device according to claim 8, further comprising a detecting unit that, when the collecting unit receives the sheet stack, measures a height of a top surface of the sheet stack resting on the free end, wherein the rotation control unit adjusts an angle of rotation of the rotational member based on the height detected at the detecting unit so that the sheet stack that is present on the collecting unit is maintained at a flat level.

17. An image forming apparatus comprising:

an outer body;

an image forming unit arranged inside the outer body and configured to form an image on a recording sheet; and a sheet finishing device arranged inside the outer body and configured to perform certain processing on the recording sheet, wherein the sheet finishing device is the sheet finishing device according to claim 8.

18. The image forming apparatus according to claim 17, further comprising an image reading unit that acquires image data by optically scanning the original image, wherein the image forming unit forms the image on the recording sheet by using the image data read by the image reading unit.

* * * * *